United States Patent [19]

Offutt et al.

[11] Patent Number: 4,479,162

[45] Date of Patent: Oct. 23, 1984

[54] HIGH SPEED RECIPROCAL ELECTROMAGNETIC ACTUATOR WITH CANCELLED RETARDING-FLUX

[75] Inventors: Warren B. Offutt, Geneva, Ill.; Jerome K. Hastings, Sussex, Wis.

[73] Assignee: Eaton Corporation, Cleveland, Ohio

[21] Appl. No.: 406,696

[22] Filed: Aug. 9, 1982

[51] Int. Cl.[3] ..... H01H 51/22; H01F 7/08

[52] U.S. Cl. ..... 361/210; 361/191; 335/255; 335/266; 335/268

[58] Field of Search ..... 335/182, 183, 255, 256, 335/266, 268, 269; 361/191, 192, 193, 166, 167, 210

[56] References Cited

U.S. PATENT DOCUMENTS

| | | | |
|---|---|---|---|
| 2,082,121 | 6/1937 | Rypinski | 335/256 |
| 3,183,410 | 5/1965 | Flora | 335/261 |
| 3,784,943 | 1/1974 | Morkowitz et al. | 335/266 |

FOREIGN PATENT DOCUMENTS

| | | | |
|---|---|---|---|
| 112064 | 9/1964 | Czechoslovakia | 335/182 |

*Primary Examiner*—E. A. Goldberg
*Assistant Examiner*—George Andrews
*Attorney, Agent, or Firm*—Andrus, Sceales, Starke & Sawall

[57] ABSTRACT

An electromagnetic actuator is provided by a single armature plunger that reciprocally shuttles between two magnetic paths provided by a pair of coils. Undesired retarding-flux is cancelled in overlapping linkage paths through the plunger, yielding increased net magnetic force in the intended direction of movement and faster plunger operation. When either coil is energized, a primary flux path is created around that coil through the plunger, and a secondary flux path is created around both coils through the plunger. The primary path attracts the plunger to close a magnetic air gap. The secondary path holds the plunger in place. Current to the ON coil is also supplied through a limiting resistor to the OFF coil to generate reverse polarity flux in the latter cancelling secondary flux from the ON coil.

21 Claims, 2 Drawing Figures

HIGH SPEED RECIPROCAL ELECTROMAGNETIC ACTUATOR WITH CANCELLED RETARDING-FLUX

BACKGROUND AND SUMMARY

The invention relates to an electromagnetic actuator having a single armature plunger that reciprocally shuttles between two magnetic paths. The invention affords optimal utilization of the magnetic circuit, including cancellation of undesired retarding-flux in overlapping linkage paths, resulting in increased net magnetic force and faster plunger operation.

In one desirable aspect of the invention, non-magnetic spacers may be eliminated. The nonmagnetic spacers may otherwise be needed for producing reluctance to control the ratio between two magnetic flux path forces. This control is necessary to insure that the dominant magnetic force is in the intended direction of plunger movement.

Another desirable aspect of the invention is its three-wire control capability, eliminating the need for two dedicated wires for each magnetic path.

A pair of coils are energizable to create magnetic fluxes having portions of their linkage paths in common, including through the plunger. When either coil is energized, a primary flux path is created around that coil through the plunger, and a secondary flux path is created around both coils through the plunger. The primary flux attracts the plunger to close a first gap, and the secondary flux attracts the plunger in the opposite direction to maintain a second gap closed.

In accordance with the preferred embodiment of the invention, current to the energized coil is also supplied through a current limiting resistor to the other coil to generate reverse polarity flux around the latter opposing the noted secondary flux in cancelling relation. This reduces or eliminates the retarding-flux in the closed gap and enables the plunger to rapidly move under the influence of the noted primary flux in the open gap.

DETAILED DESCRIPTION

Figure 1:
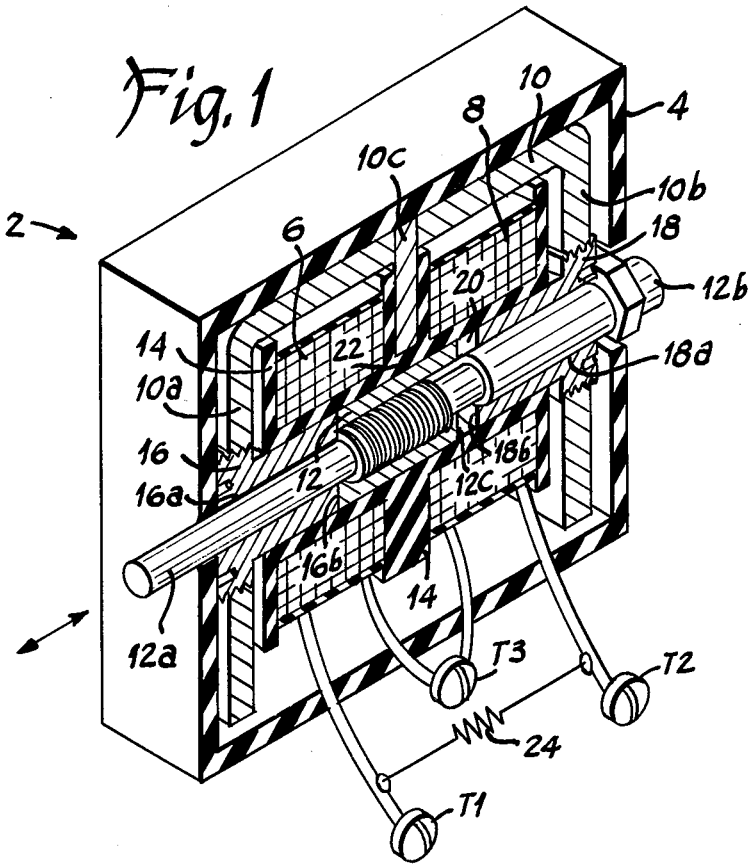
FIG. 1 is a cutaway isometric view of electromagnetic actuator means and circuitry constructed in accordance with the invention.
Figure 2:
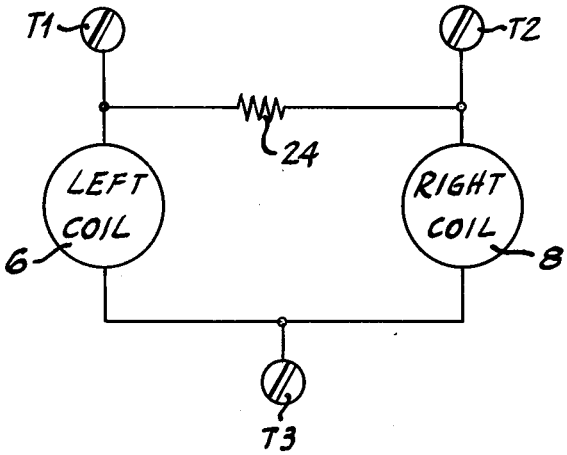
FIG. 2 is a schematic diagram of the energization circuit of FIG. 1.

Electromagnetic actuator means 2 includes a housing 4 having a pair of coaxial coils 6 and 8 energizable through terminals T1, T2 and T3 to create magnetic flux. Magnetically permeable yoke 10 directs the flux paths of the coils. An armature plunger 12 reciprocally shuttles between left and right positions.

Coils 6 and 8 are mounted on an insulating bobbin 14 having an axial passage for guiding the reciprocal left-right movement of plunger 12. Yoke 10 is an E-shaped member having first and second outer legs **10*a* and 10*b* and a center leg 10*c*. The yoke further includes left and right magnetically permeable insets 16 and 18 screwed into outer legs 10*a* and 10*b*. Insets 16 and 18 have axial bores 16*a* and 18*a* therethrough for guiding axial reciprocal movement of extension shafts 12*a* and 12*b* secured to plunger 12 in threaded relation. Inner inset edge 16*b* provides a shoulder stop for limiting leftward axial movement of plunger 12. Inner inset edge 18*b* provides a right shoulder stop for limiting rightward axial movement of plunger 12**.

When plunger 12 is in the leftward position shown in FIG. 1, energization of right coil 8 creates a primary flux path extending around right coil 8 through plunger 12 attracting the latter to a rightward position to close axial magnetic air gap 20. Energization of right coil 8 also creates a secondary path around both coils through the plunger attracting the latter in the opposite direction to its leftward position against shoulder stop **16*b*. The primary flux path extends around energized coil 8 through yoke means 10 and plunger 12, specifically through right outer yoke leg 10*b*, through inset 18, through axial gap 20 between shoulder stop 18*b* and the right edge 12*c* of the plunger, through plunger 12, through a radial gap 22 across bobbin 14 between plunger 12 and center yoke leg 10*c*, through center yoke leg 10*c* and back to right outer yoke leg 10*b* to complete the primary loop. The secondary path, created when right coil 8 is energized, extends around both coils 6 and 8, specifically through right outer yoke leg 10*b*, through inset 18, through axial gap 20, through plunger 12, through shoulder stop and inset 16, through left outer yoke leg 10*a*, and back to right outer yoke leg 10*b* to complete the secondary loop. The structure is symmetric, and the above description likewise applies when coil 6 is energized and plunger 12 is in its rightward position with gap 20** closed.

When either coil is energized, the primary and secondary flux forces urge opposite directions of movement of the plunger. One path must always overpower the other, regardless of which coil is energized, if there is to be reciprocal movement of the plunger in an intended direction of movement.

In the present invention the ratio of the permeances of the magnetic paths is controlled by circuit means such that one path always overpowers the other, to insure plunger movement in either direction. Circuit means are provided responsive to energization of either one of the coils to generate flux in the other coil opposing the noted secondary path flux. This reduces the net flux holding the plunger in place, and affords faster plunger movement responsive to the primary flux in the open magnetic air gap for example gap 20. In the preferred embodiment, the coils are connected in reverse polarity, for example by winding the coils in opposite polarity directions around the bobbin. A first terminal T1 is provided for energizing coil 6, a second terminal T2 is provided for energizing coil 8, and a current limiting resistor 24 is connected between terminals T1 and T2 for applying reduced current to coil 8 from T1 and for applying reduced current to coil 6 from T2. A common return for both terminals is provided at T3.

With plunger 12 in its leftward position in FIG. 1, energization of coil 8 at terminal T2 creates the above noted primary and secondary flux path forces. Current from terminal T2 also flows through resistor 24 to left coil 6 to energize the latter in reduced reverse polarity relation to decrease or cancel the retarding secondary flux otherwise holding plunger 12 in place in its leftward position against shoulder stop **16*b*. This reduction or cancellation of retarding-flux enables faster movement of plunger 12 to its rightward position in response to the primary flux in the open magnetic air gap 20. The same considerations apply for reverse direction movement of plunger 12 in response to energization of coil 6 at terminal T1**.

The ratio of the permeances of the primary and secondary paths may be controlled in other manners, for example as taught in copending application Ser. No. 406,614, filed Aug. 9, 1982. A pair of reluctance-producing nonmagnetic spacer washers may be provided adjacent each respective shoulder stop 16*b* and 18*b* to afford an axial gap between each yoke edge 16*b* and 18*b* and plunger 12 in its left and right positions. The ratio of the primary and secondary path permeances is controlled by the ratio of the axial width of the respective nonmagnetic spacer and the radial width of gap 22. This ratio of widths is controlled such that the primary path flux force always overcomes the secondary path flux force.

The present invention not only insures that the primary flux path force always overcomes the secondary flus path force, but additionally cancels the retarding secondary flux force to thus increase the net magnetic force on the plunger in the other direction to close the magnetic air gap. Nonmagnetic spacers may of course be used if desired.

Extension shafts 12*a* and 12*b* are provided to perform a designated task, such as closing or opening electric contacts, a hydraulic circuit, or various other given functions. The shafts need not be identical, as shown at enlarged shaft 12*b* further including an integral hex nut near its end.

Armature shuttle plunger 12 is thus reciprocal in housing 4 between left and right positions respectively closing and opening first and second gaps between plunger 12 and yoke 10 at inset shoulder stop 16*b* and 18*b*. Plunger 12 is in overlapping flux paths in each of its left and right positions. Energization of the right coil 8 creates a primary flux around the latter attracting the plunger to its rightward position to close right gap 20 and open a left gap between the left edge of plunger 12 and left shoulder stop 16*b*. Energization of right coil 8 also creates a secondary flux around both coils attracting plunger 12 to remain in its leftward position with the left gap closed and the right gap 20 open. Energization of left coil 6 creates a primary flux around the latter attracting plunger 12 to its leftward position to close the left gap and open the right gap 20, and creates a secondary flux around both coils attracting plunger 12 to remain in its rightward position with right gap 20 closed and the left gap open.

It is recognized that various modifications are possible within the scope of the appended claims.

We claim:

1. Electromagnetic actuator means having a pair of coaxial coils and magnetically continuous yoke means and comprising an armature plunger for reciprocally axially shuttling between magnetic paths having common overlapping portions through the plunger provided by the yoke means directing the flux paths of the pair of coils such that when either coil is energized a first flux path is created around that coil through the plunger and a second flux path is created around both coils through the plunger, the first path pulling the plunger to close an axial magnetic air gap, the second path holding the plunger in place, the flux paths from the axial ends of the plunger extending substantially only axially to the yoke means, the yoke means having a central leg extending radially between the coils, the leg having an inner end facing the plunger and separated therefrom by a radial gap, the axial length of the radial gap being no greater than the axial spacing of the coils, the ratio of the permeances of the two paths being controlled by electric circuit means such that one path always overpowers the other, preventing residual magnetic latching, to insure plunger movement in either direction without the need for mechanical assistance.

2. The invention according to claim 1 wherein said circuit means comprises means responsive to energization of either one of said coils to generate flux in the other coil opposing said second path flux to reduce the net flux holding said plunger in place and afford faster plunger movement responsive to said first path flux in said magnetic air gap.

3. The invention according to claim 2 wherein said circuit means comprises means for connecting said coils in reverse polarity including a first terminal for energizing a first said coil, a second terminal for energizing a second said coil, and a current limiting resistor connected between said first and second terminals for applying reduced current to said second coil from said first terminal and for applying reduced current to said first coil from said second terminal.

4. The invention according to claim 3 wherein said coils are wound in opposite directions.

5. Electromagnetic actuator means having a pair of coaxial coils and magnetically continuous yoke means and comprising an armature plunger for reciprocally axially shuttling between magnetic paths provided by said pair of coils energizable to create magnetic fluxes having portions of their linkage paths in common, including through said plunger, such that when either coil is energized a flux path is created around that coil through the plunger, and another flux path is created around both coils through the plunger, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils, the ratio of the permeances of the two paths being controlled by circuit means including means for reducing retarding-flux in said other path to increase the net magnetic force on said plunger, preventing residual magnetic latching, and enhance faster movement of said plunger in either direction without the need for mechancial assistance.

6. The invention according to claim 5 wherein said circuit means comprises means responsive to energization of either said coil to energize the other coil in reduced reverse flux polarity relation.

7. The invention according to claim 5 wherein said circuit means comprises means for connecting said coils in reverse polarity including a first terminal for energizing a first said coil, a second terminal for energizing a second said coil, and including a current limiting resistor connected between said first and second terminals.

8. Electromagnetic actuator means comprising:

a housing;

a pair of coils coaxially mounted in said housing and energizable to create magnetic flux having common overlapping flux linkage path portions;

magnetically continuous yoke means in said housing for directing the flux paths of said coils through portions of common overlapping flux linkage;

an armature shuttle plunger axially reciprocal in said housing according to energization of a respective said coil such that when either coil is energized a primary flux path is created around that coil through the plunger and a secondary flux path is created around both coils through the plunger, said primary and secondary flux forces urging opposite directions of movement of said plunger, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils; and circuit means for reducing the flux in said secondary path, preventing residual magnetic latching, to enhance faster movement of said plunger under the influence of said primary flux path without the need for mechanical assistance.

9. The invention according to claim 8 wherein;

said common overlapping linkage path extends axially through said plunger, and said plunger reciprocates axially therealong;

said primary flux path tends to pull said plunger to close an axial magnetic air gap, and said secondary flux path tends to hold said plunger in place; and said circuit means comprises means responsive to energization of either coil to energize the other coil with reverse flux polarity.

10. High speed electromagnetic actuator means comprising:

a housing;

first and second coaxial coils in said housing energizable to create magnetic flux;

magnetically continuous yoke means in said housing for directing the flux of said coils in partially overlapping paths;

an armature shuttle plunger axially reciprocal in said housing between first and second positions according to energization of a respective said first or second coil providing a primary flux path around the respective said energized coil through said plunger attracting said plunger toward said energized coil, and providing a secondary flux path around both said coils through said plunger attracting said plunger toward the other coil, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils; and circuit means for reducing the flux in said secondary path, preventing residual magnetic latching, to enhance faster movement of said plunger toward the energized coil responsive to said primary flux path without the need for mechanical assistance.

11. The invention according to claim 10 wherein said circuit means comprises means responsive to energization of either said coil to energize the other coil in reduced reverse flux polarity relation.

12. The invention according to claim 10 wherein said circuit means comprises means for connecting said coils in reverse polarity including a first terminal for energizing said first coil, a second terminal for energizing said second coil, and a third terminal providing a common return for both said coils, and including a current limiting resistor connected between said first and second terminals, such that when said plunger is in said second position and said first coil is energized from said first terminal, said primary flux path extends around said first coil through said plunger attracting the latter to said first position, and said secondary path extends around both said coils through said plunger attracting the latter to remain in said second position, and reduced current is applied from said first terminal through said resistor to said second coil to generate reduced reverse polarity flux in the latter opposing said last mentioned secondary path flux in cancelling relation to enhance rapid plunger movement to said first position, and such that when said plunger is in said first position and said second coil is energized from said second terminal, said primary flux path extends around said second coil through said plunger attracting the latter to said second position, and said secondary path extends around both said coils through said plunger attracting the latter to remain in said first position, and reduced current is applied from said second terminal through said resistor to said first coil to generate reduced reverse polarity flux opposing said last mentioned secondary path flux in cancelling relation to enhance rapid plunger movement to said second position.

13. The invention according to claim 12 wherein said coils are wound in opposite directions.

14. High speed electromagnetic actuator means comprising:

a housing;

first and second coaxial coils in said housing energizable to create magnetic flux;

magnetically continuous yoke means in said housing for directing the flux of said coils in partially overlapping paths;

an armature shuttle plunger in said housing axially reciprocal between first and second positions respectively closing and opening first and second axial gaps between said plunger and said yoke means, said plunger being in said overlapping flux paths in each of said first and second positions, energization of said first coil creating a primary flux around the latter attracting said plunger to said first position to close said first gap and open said second gap, and creating a secondary flux around both said coils attracting said plunger to remain in said second position with said second gap closed and said first gap open, energization of said second coil creating a primary flux around the latter attracting said plunger to said second position to close said second gap and open said first gap, and creating a secondary flux around both said coils attracting said plunger to remain in said first position with said first gap closed and said second gap open, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils; and circuit means responsive to energization of either one of said coils to generate flux in the other coil opposing said secondary flux from said one coil to reduce the net flux in the closed gap, preventing residual magnetic latching, and afford plunger movement responsive to the primary flux in the open gap without the need for mechanical assistance.

15. The invention according to claim 14 wherein said circuit means comprises means for connecting said coils in reverse polarity including a first terminal for energizing said first coil, a second terminal for energizing said second coil, and a current limiting resistor connected between said first and second terminals for applying reduced current to said second coil from said first terminal and for applying reduced current to said first coil from said second terminal.

16. The invention according to claim 15 wherein said coils are wound in opposite directions.

17. High speed reciprocal electromagnetic actuator means comprising:

a housing;

first and second coils coaxially mounted in said housing and energizable from respective first and second terminals to create magnetic flux;

magnetically continuous yoke means in said housing for directing the flux paths of said coils;

an armature plunger axially reciprocal in said housing between first and second positions according to energization of a respective said coil providing a primary flux path around the respective energized coil through said yoke means and said plunger, and providing a secondary flux path around both said coils through said yoke means and said plunger, the flux paths from the axial ends of said plunger extending substantially only axially to said yoke means, said yoke means having a central leg extending radially between said coils, said leg having an inner end facing said plunger and separated therefrom by a radial gap, the axial length of said radial gap being no greater than the axial spacing of said coils; and means responsive to energization of either coil to energize the other coil with reverse flux polarity opposing said secondary path flux force, preventing residual magnetic latching and insuring plunger movement from either said position without the need for mechanical assistance.

18. The invention according to claim 17 wherein:

said last mentioned means comprises resistor means connected between said first and second terminals;

said yoke means includes first and second axially spaced stop shoulders for limiting said axial movement of said plunger at respective said first and second positions;

such that when said plunger is in said second position and said first coil is energized from said first terminal, said primary flux path extends around said first coil through said yoke means and across an axial gap between said first stop shoulder of said yoke means and said plunger and through said plunger and across said radial gap between said plunger and said central leg of said yoke means, and said secondary path extends around both said coils through said yoke means and across an axial gap between said first stop shoulder of said yoke means and said plunger and through said plunger and through said second stop shoulder of said yoke means, said first terminal supplying current through said resistor means to said second coil to generate said reverse flux around the latter through said yoke means and said plunger and across said radial gap between said plunger and said central leg of said yoke means in opposing relation to said last mentioned secondary path flux force, such that said plunger moves to said first position responsive to said last mentioned primary path flux force; and such that when said plunger is in said first position and said second coil is energized from said second terminal, said primary flux path extends around said second coil through said yoke means and across an axial gap between said second stop shoulder of said yoke means and said plunger and through said plunger and across said radial gap between said plunger and said central leg of said yoke means, and said secondary path extends around both said coils through said yoke means and across said axial gap between said second stop shoulder of said yoke means and said plunger and through said plunger and through said first stop shoulder of said yoke means, said second terminal also supplying current through said resistor means to said first coil to generate said reverse flux around the latter through said yoke means and across said radial gap between said plunger and said central leg of said yoke means and through said plunger and through said first stop shoulder of said yoke means in opposing relation to said last mentioned secondary path flux such that said plunger moves to said second position responsive to said last mentioned primary path flux force.

19. High speed reciprocal electromagnetic actuator means with cancelled retarding-flux comprising:

a housing;

first and second coaxial coils in said housing energizable from respective first and second terminals to create magnetic flux;

an armature shuttle plunger in said housing axially movable between first and second positions;

magnetically continuous yoke means in said housing for directing the flux paths of said coils, said yoke means having a first portion spaced from said plunger by a first axial gap when said plunger is in said second position, said yoke means having a second portion spaced from said plunger by a second axial gap when said plunger is in said first position, said yoke means having a third portion spaced from said plunger by a third gap in each of said first and second plunger positions, the flux paths from the axial ends of said plunger extending substantially only axially through respective said first and second gaps to said yoke means, said third portion of said yoke means being a central leg extending radially between said coils, said leg having an inner end facing said plunger and separated radially therefrom by said third gap, the axial length of said third gap being no greater than the axial spacing of said coils; and current limiting resistor means connected between said first and second terminals, such that when said plunger is in said second position and said first coil is energized from said first terminal a primary flux path is created and extends around said first coil through said yoke means and said plunger and across said first and third gaps, and a secondary flux path is created and extends around both said coils through said yoke means and said plunger and across said first gap, said primary path flux force attracting said plunger to said first position to close said first gap, said secondary path flux force attracting said plunger to remain in said second position, said first terminal also supplying reduced current through said resistor to said second coil to generate reduced reverse polarity flux in the latter opposing said secondary path flux in cancelling relation, preventing residual magnetic latching, whereby to afford faster movement of said plunger to said first position without the need for mechanical assistance, and such that when said plunger is in said first position and said second coils is energized from said second terminal, a primary flux path is created and extends around said second coil through said yoke means and said plunger and across said second and third gaps, and a secondary flux path is created and extends around both said coils through said yoke means and said plunger and across said second gap, said last mentioned primary path flux force attracting said plunger to said second position to close said second gap, said last mentioned secondary path flux force attracting said plunger to remain in said first position, said second terminal also applying reduced current through said resistor to said first coil to generate reduced reverse polarity flux in the latter opposing said last mentioned secondary path flux in cancelling relation, preventing residual magnetic latching, whereby to afford faster movement of said plunger to said second position without the need for mechanial assistance.

20. The invention according to claim 19 wherein:

said reduced reverse polarity flux in said second coil, when said first coil is energized, reduces the net said first mentioned secondary path flux force to a value below said first mentioned primary path flux force without non-magnetic spacer means between said yoke means and said plunger in said second position; and said reduced reverse polarity flux in said first coil, when said second coil is energized, reduces the net said second mentioned secondary path flux force to a value below said first mentioned primary path flux force without non-magnetic spacer means between said yoke means and said plunger in said first position.

21. A three-wire controlled high speed electromagnetic actuator comprising:

a housing;

first and second coaxial coils in said housing energizable from respective first and second terminals to create magnetic flux;

resistor means connected between said first and second terminals;

a third terminal providing a common return for both said coils;

magnetically continuous yoke means in said housing for directing the flux of said coils in partially overlapping paths;

an armature shuttle plunger in said housing reciprocal between first and second positions respectively closing and opening first and second axial gaps between said plunger and said yoke means, said plunger being in said overlapping flux paths in each of said first and second positions, the flux paths from the axial ends of said plunger extending substantially only axially through respective said first and second gaps to said yoke means, said yoke means having a central leg extending radially between said coils, said leg having an inner end facing said plunger and separated therefrom by a radial gap, the axial length of said radial gap being no greater than the axial spacing of said coils, energization of said first coil from said first terminal, with said plunger in said second position, creating a primary flux path around said first coil attracting said plunger to said first position to close said first gap and open said second gap, and creating a secondary flux around both said coils attracting said plunger to remain in said second position with said second gap closed and said first gap open, said first terminal also supplying current through said resistor to said second coil to create reverse polarity flux around the latter opposing said secondary path flux in cancelling relation to thus reduce the flux in said closed gap, preventing residual magnetic latching, and afford rapid plunger movement to said first position under the influence of said primary flux in said open first gap without the need for mechanical assistance, energization of said second coil from said second terminal, with said plunger in said first position, creating a primary flux path around said second coil attracting said plunger to said second position to close said second gap and open said first gap, and creating a secondary flux around both said coils attracting said plunger to remain in said first position with said first gap closed and said second gap open, said second terminal also supplying current through said resistor means to said first coil to generate reverse polarity flux around said first coil opposing said last mentioned secondary flux to reduce the flux in said closed first gap, preventing residual magnetic latching, and enable rapid movement of said plunger under the influence of said last mentioned primary flux in said open second gap without the need for mechanical assistance.

* * * * *